US007543785B1

(12) United States Patent
Liles

(10) Patent No.: US 7,543,785 B1
(45) Date of Patent: Jun. 9, 2009

(54) WIRE SUPPORT AND METHOD OF MAKING

(76) Inventor: John Kevin Liles, 701 SE. 43rd Ave., Ocala, FL (US) 34471

( * ) Notice: Subject to any disclaimer, the term of this patent is extended or adjusted under 35 U.S.C. 154(b) by 0 days.

(21) Appl. No.: 10/692,037

(22) Filed: Oct. 23, 2003

Related U.S. Application Data

(60) Provisional application No. 60/420,872, filed on Oct. 24, 2002.

(51) Int. Cl.
*G09F 19/00* (2006.01)

(52) U.S. Cl. ..... 248/175; 248/465.1; 40/606.1

(58) Field of Classification Search ..... 248/175, 248/465.1; 40/606.01, 606.11
See application file for complete search history.

(56) References Cited

U.S. PATENT DOCUMENTS

| | | | | |
|---|---|---|---|---|
| D32,692 | S | 5/1900 | Muth | |
| 899,946 | A * | 9/1908 | Browne | 47/47 |
| 933,112 | A * | 9/1909 | Rieman | 47/47 |
| 948,671 | A * | 2/1910 | Muller | 47/47 |
| 1,344,226 | A * | 6/1920 | Hantsch | 211/22 |
| 1,958,716 | A * | 5/1934 | Roach et al. | 248/156 |
| 2,094,129 | A | 9/1937 | Manahan | |
| D150,499 | S * | 8/1948 | Heim | D9/517 |
| 2,563,159 | A * | 8/1951 | Clark | 40/664 |
| 2,764,379 | A | 9/1956 | Schmidt | |
| 2,872,750 | A | 2/1959 | Holcomb | |
| 2,976,000 | A | 3/1961 | Gunderson | |
| 3,684,224 | A * | 8/1972 | Kwako | 248/87 |
| 3,987,582 | A * | 10/1976 | Williams | 446/268 |
| 4,103,445 | A | 8/1978 | Smith et al. | |
| 4,658,527 | A | 4/1987 | Pingel | |
| 4,660,310 | A | 4/1987 | Farmer | |
| 4,885,860 | A | 12/1989 | Huenefeld | |
| 4,894,937 | A | 1/1990 | Davis | |
| 4,913,389 | A * | 4/1990 | McCracken | 248/156 |
| 5,042,183 | A * | 8/1991 | Kennedy | 40/607.06 |
| 5,103,582 | A | 4/1992 | Farmer | |
| 5,307,580 | A | 5/1994 | Farmer | |
| 5,566,483 | A | 10/1996 | Ogren | |
| 5,579,599 | A | 12/1996 | Haeseler | |
| 5,595,010 | A | 1/1997 | Fuller et al. | |
| 5,682,696 | A | 11/1997 | Gill | |
| 5,878,517 | A | 3/1999 | Gill | |
| D431,036 | S | 9/2000 | Chapman et al. | |
| 6,258,420 | B1 * | 7/2001 | Lehman | 428/7 |

* cited by examiner

*Primary Examiner*—Korie Chan
*Assistant Examiner*—Steven Marsh
(74) *Attorney, Agent, or Firm*—Frijouf, Rust & Pyle P.A.

(57) ABSTRACT

A wire support and a method of making is disclosed for supporting an object from a base surface. The wire support comprises a plurality of wires with each of the wires having a lower section, an intermediate section and an upper section. The plurality of wires are twisted along the intermediate sections for providing an upright support. The lower sections of the plurality of wires extend outwardly from the upright support for insertion into the base surface to mount the wire support. The upper section of the plurality of wires extends outwardly from the upright support for engaging with the object to support the object relative to the base surface.

3 Claims, 15 Drawing Sheets

WIRE SUPPORT AND METHOD OF MAKING

CROSS-REFERENCE TO RELATED APPLICATIONS

This application claims benefit of U.S. Patent Provisional application Ser. No. 60/420,872 filed Oct. 24, 2002. All subject matter set forth in provisional application Ser. No. 60/60/420,872 is hereby incorporated by reference into the present application as if fully set forth herein.

BACKGROUND OF THE INVENTION

1. Field of the Invention

This invention relates to a wire support and more particularly to an improved twisted metal wire support for supporting an object from a base surface and a method of making the wire support.

2. Background of the Invention

Signs have been used throughout history to convey ideas and identifications in addition to marketing and advertising products and services. Early shop keepers and tradesmen devised signs with emblems representing products or services enabling an essentially illiterate public to identify the facility of the merchant or tradesman. As the population became literate, signs containing text emerged. In modern times, signs of many types, styles and sizes proliferated and are now responsible for conveying information vital to our everyday needs and desires.

The signs may be classified as either permanent or temporary. Permanent signs include those identifying permanently located businesses and the like. Temporary signs include real estate for sale signs, political advertising signs, for rent signs, as well as signs identifying yard or garage sales and the like. Temporary signs have unique requirements, quite different from those of permanently installed signs. Since temporary signs are not expected to withstand the ravages of long term extensive exposure to the elements, the materials requirements for temporary signs are less stringent. However, temporary signs must withstand short term exposure to sun and rain, as well as withstanding reasonable wind loads. Since abandoned signs degrade and the theft and vandalism rate for temporary signs is higher than permanent signs, the cost of temporary signs must be maintained as low as possible. Temporary signs must also be designed for ease of installation in a variety of environments by persons relatively unskilled in sign installation.

A variety of sign holding devices has been described in the literature. The following U.S. patents are representative of some of the attempts of the prior art to provide improvements to the art.

U.S. Pat. D 32,692 to Adelbert T. Muth discloses a sign holder with an upper circular looped terminal supported by a twisted stem having an open circular base.

U.S. Pat. No. 2,094,129 to George H. Manahan discloses a combined grave marker and flower vase. The invention comprises a casing open at one end and closed at the other end, an epitaph marker mounted on the outer side of the closed end of the casing and rigid with respect to the casing, and means for supporting the casing with either end uppermost. The casing acts as a flower vase when mounted with its open end uppermost, and as an epitaph marker when reversed.

U.S. Pat. No. 2,764,379 to Edward F. Schmidt discloses a standard comprising, a plurality of rods projecting upwardly from spaced points. A cap is provided with spaced holes receiving the upper ends of the rods. The spacing of the holes in the cap is less than the spacing of the lower ends of the rods and the axes of the holes in the cap being angularly related to the central axis of the standard to snugly receive the upper ends of the rods. A resilient collar encircles the intermediate the ends of the rods, drawing the rods together and acting to impart a twist to the rods about the central axis.

U.S. Pat. No. 2,872,750 to Willis C. Holcomb discloses a demountable frame assembly for displaying a sheet material sign. The frame includes a pair of channel posts extending vertically, the channels being directed towards each other. A plurality of rivets are mounted in the posts, with one of the rivets in each post being located in spaced relation to two other rivets arranged one above the other in close relation to each other. A plurality of cross bars is provided, with one of the cross bars having diagonally disposed notches in each end thereof. The notches being positioned on the one rivet in each post. The diagonal notch prevents removal of the bar due to the diagonal notches when the posts are parallel to each other. A second bar is disclosed having a vertically disposed notch near each end thereof. The notches in the second bar being seated upon the two closely spaced rivets. A third channel bar is described, having the channel directed downwardly with the upper margin of the sign projecting upwardly into the channel of the third bar. Means for removably attaching the third bar to the posts is provided.

U.S. Pat. No. 2,976,000 to Ralph R. Gunderson discloses a resilient support for an indicating sign. The support comprises a length of coil spring having closely coiled convolutions affording a central longitudinal opening through the coil spring. A length of flexible wire is positioned within the central opening. The wire being of a size so that its outer lateral surface is closely adjacent to the inner surfaces of the convolutions of the coil spring, whereby lateral flexing forces on the spring are distributed by the inner surfaces of the convolutions longitudinally of the embraced wire to prevent the wire from assuming a set position. One end portion of the wire being retained adjacent a corresponding end portion of the coil spring so as to prevent longitudinal movement of the wire with respect to the coil spring in one direction, and the other end portion of the wire extending outwardly of the opposite end portion of the coil spring. Means secured to the other end portion of the wire and being adapted to engage the indicating sign to secure the support to the indicating sign is provided.

U.S. Pat. No. 4,103,445 to David A. Smith et al. discloses a portable sign assembly comprising a rigid knockdown frame and a flexible display web. In a collapsed condition elements of the sign assembly afford a relatively small package size which is conveniently handled and economically shipped. The sign is quickly assembled and disassembled by simple manipulation of the frame elements. In accordance with an important aspect of the invention, the display web is provided with relatively high elastic elongation properties and the frame is arranged to slightly stretch the web to thereby completely tension it and ensure that it is drawn into a planar configuration.

U.S. Pat. No. 4,658,527 to Matthias A. Pingel, discloses a sign holder comprising a panel including spaced front and rear panel members. At least one of the panel members is adapted to receive indicia thereon for display purposes. A plurality of vertically spaced, transverse extending web members are connected between the front and rear panel members. The web members with adjacent portions of the front and rear panel members define a plurality of vertically spaced, transversely extending channels. To support the panel in a vertical position, a pair of support elements are provided. One of the support elements is provided on each transverse side of the panel. To suspend the panel from the support elements, a pair of pin members are provided, each pin member having one end removably connected to respective one of the support elements and an opposite end removably received in at least one of the channels of the panel.

U.S. Pat. No. 4,660,310 to Kenneth R. Farmer discloses an advertising display sign and stand combination which comprises a double sided display sign having printed thereon advertising copy and changeable copy display area and stand member removably attached to the double sided display side adapted to allow the sign stand combination to be implanted I the earth without the use of tools.

U.S. Pat. No. 4,885,860 to Robert C. Huenefeld discloses a yard sign having two display panels. Each display panel is of pan shaped configuration and adapted to nest one within the other so that a cavity is formed therebetween. An H-shaped support frame is positioned within the nested panels with only that portion of the frame's legs that extend below the frames's crossbar being located exteriorly of the display panels. The top edges of the H-frame's legs abut the nested display panels' top edge to prevent the display panels from sliding down on the support frame, and the support frame's crossbar abuts the nested display panel's bottom edge to prevent the pans from sliding up on the support frame. The legs are spaced apart one from the other a distance sufficient to minimize twisting of the display panels on the support frame relative to the sign's vertical center axis.

U.S. Pat. No. 4,894,937 to R. P. Stephen Davis discloses a stake for holding a sign upright and comprising at least two parallel and spaced-apart elongate legs, one end of which legs for being driven into the ground and the other end of which legs for supporting a sign above the ground. At least two longitudinally spaced-apart cross-members are secured to and connect the legs together. At least one of the cross-members comprises a step for being used to drive the two legs into the ground for supporting a sign on the other end. The other end of the legs comprises thin wire-like members for extending into the open areas of a corrugated sign or for holding a fiberboard sign. The other cross-member supports the sign at a predetermined distance above the cross-member which comprises the step.

U.S. Pat. D 431,036 to Marcia L. Chapman et al discloses a design for a compact disc pic, for use in floral arrangements and the like, as shown and described.

Therefore, it is an object of the present invention to provide an improved wire support for supporting an object from a base surface that overcomes the inadequacies of the prior art and provides a significant contribution to the art.

Another object of this invention is to provide an improved wire support for supporting an object from a base surface which is easy to manufacture.

Another object of this invention is to provide an improved wire support for supporting an object from a base surface which is economical and easy to use.

Another object of this invention is to provide an improved wire support for supporting an object from a base surface which is may be folded for transport.

Another object of this invention is to provide an improved wire support for supporting an object from a base surface which is essentially disposable.

The foregoing has outlined some of the more pertinent objects of the present invention. These objects should be construed as being merely illustrative of some of the more prominent features and applications of the invention. Many other beneficial results can be obtained by modifying the invention within the scope of the invention. Accordingly other objects in a full understanding of the invention may be had by referring to the summary of the invention, the detailed description setting forth the preferred embodiment in addition to the scope of the invention defined by the claims taken in conjunction with the accompanying drawings.

SUMMARY OF THE INVENTION

Specific embodiments of the present invention are shown in the attached drawings. For the purpose of summarizing the invention, the invention relates to an improved apparatus and method of making of a wire support for an object from a base surface. The wire support comprises a plurality of wires with each of the wires having a lower section, an intermediate section and an upper section. The plurality of wires is twisted along the intermediate sections for providing an upright support. The lower sections of the plurality of wires extend outwardly from the upright support for insertion into the base surface to mount the wire support. The upper section of the plurality of wires extends outwardly from the upright support for engaging with the object to support the object relative to the base surface.

In one embodiment of the invention the wire support comprises a plurality of wires consisting of a first and a second wire. In another embodiment of the invention the wire support comprises a plurality of wires wherein the plurality of wires are identical to one another.

In a more specific embodiment of the invention the plurality of wires includes the plurality of wires forming a plurality of helixes, wherein the plurality of helixes are spirally intertwined for providing the upright support. Each of the lower sections has a lower region extending generally transverse to the upright support for enabling an operator to apply a force to the lower region for facilitating insertion of the lower section into the base surface.

In another embodiment of the invention each of the lower sections terminates in a lower distal area extending generally parallel to the upright support for facilitating insertion of the lower section into the base surface. Each of the upper sections has an upper region extending generally transverse to the upright support for enabling an operator to apply a force to the upper region for facilitating insertion of the upper section into the object.

In a more specific embodiment of the invention each of the upper sections terminates in an upper distal area extending generally parallel to the upright support for facilitating insertion of the upper section into the object.

In another embodiment of the invention a minor length of an upper and a lower end of each of the intermediate sections of the first and the second wires comprise a straight portion. The straight portion provides lateral support to a minor bottom portion of an object inserted between the straight portions of the upper ends of the intermediate sections. The straight portions also enable rotation of the first wire relative to the second wire for folding the wire support.

In another embodiment of the invention the upper section of the plurality of wires has a first and a second end with the first end proximate the upright support. The second end is lower than the first end relative to horizontal for enabling the upper section to support the object relative to the base surface.

The invention is also incorporated into the method of making a wire support from a plurality of wires comprising the steps of forming a first wire and a second wire with the second wire being identical to the first wire. The first and second wires are installed on a twisting apparatus. The first and second wires are twisted a multiplicity of times in a first direction on the twisting apparatus. The first and second wires are removed from the twisting apparatus.

In another embodiment of the invention, the first and second wires are twisted in the first direction a first number of turns. The first and second wires are twisted a limited number of times in a second direction on the twisting apparatus with the second number being substantially less than the first number of turns.

The foregoing has outlined rather broadly the more pertinent and important features of the present invention in order that the detailed description that follows may be better understood so that the present contribution to the art can be more fully appreciated. Additional features of the invention will be described hereinafter which form the subject of the claims of the invention. It should be appreciated by those skilled in the art that the conception and the specific embodiments disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be made to the following detailed description taken in connection with the accompanying drawings in which.

Similar reference characters refer to similar parts throughout the several Figures of the drawings.

DETAILED DISCUSSION

Figure 1:
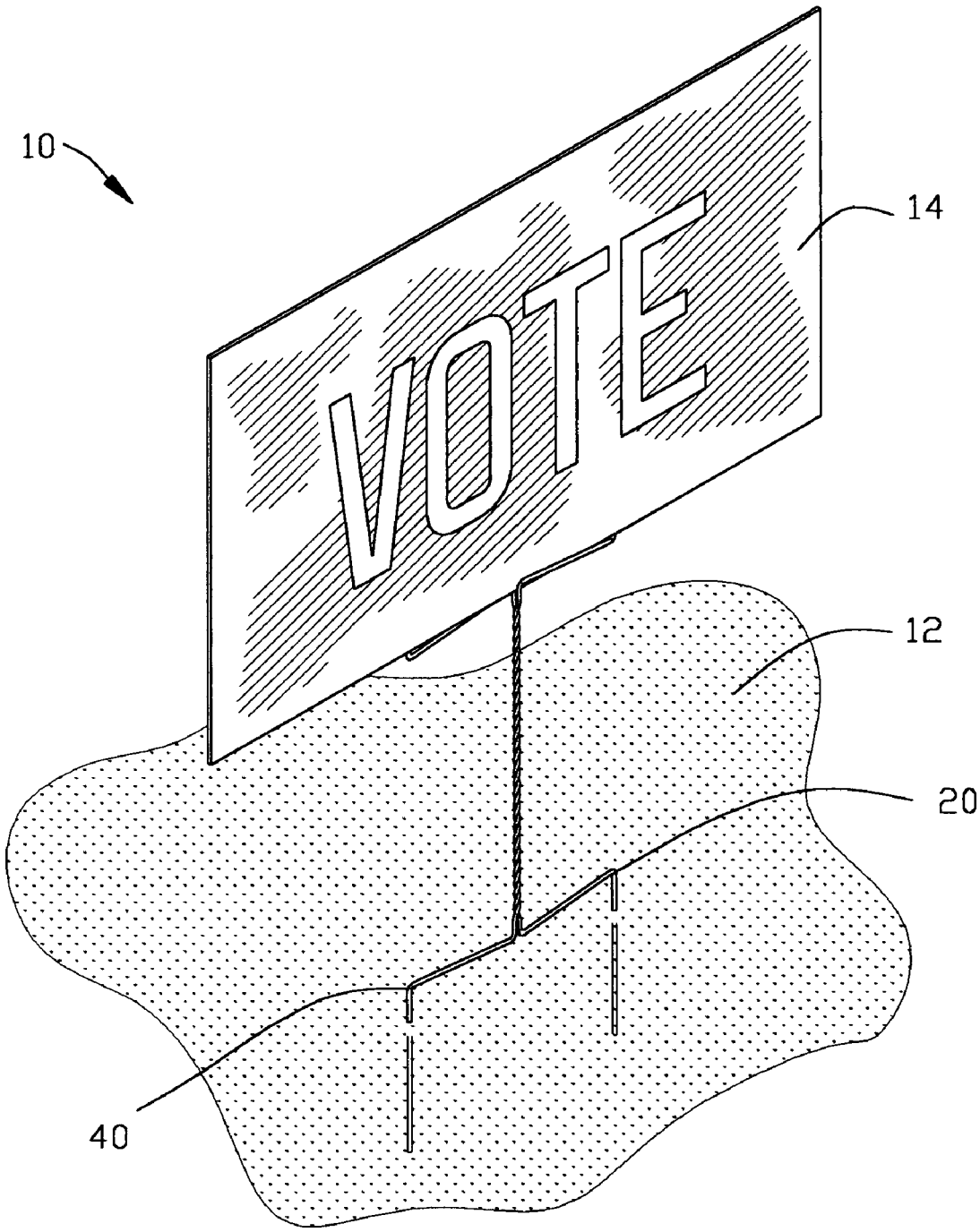
FIG. 1 is an isometric view of a wire support for supporting an object from a base surface incorporating the present invention.

FIG. 1 is an isometric view of a wire support 10 of the present invention inserted into base surface 12 for supporting object 14 shown as a sign. The object 14 may be formed from a corrugated cardboard material or a corrugated plastic material capable of withstanding degradation due to weather. The wire support 10 comprises a plurality of wires shown as a first and a second wire 20 and 40.

Figure 2:
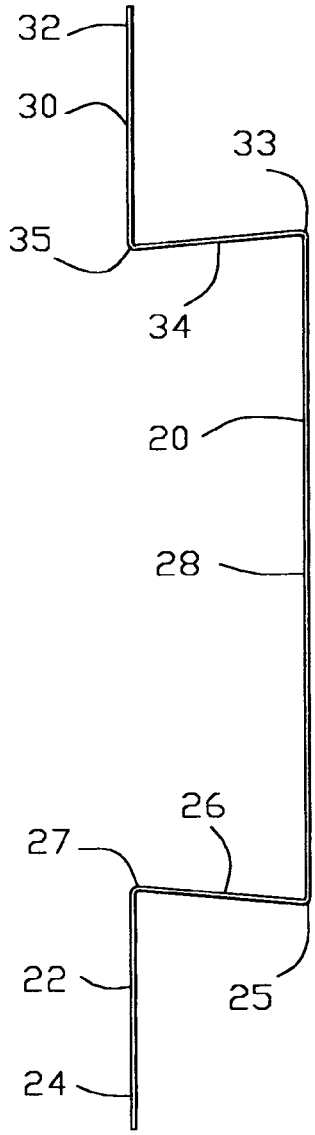
FIG. 2 is a side view of a first member of the wire support.

FIG. 2 is a side view of a first wire 20 comprising a lower section 22 and intermediate section 28 and an upper section 30. The lower section 22 comprises a first portion 24 and a second portion 26. The first portion 24 of lower section 22 is substantially parallel to intermediate section 28 and is illustrated in a vertical orientation.

The second portion 26 of lower section 22 has a first end 25 and second end 27. The first end 25 is proximate to the intermediate section 28 and second end 27 is distal to the intermediate section 28. In this example of the invention, the second end 27 is illustrated higher than the proximal end 25 relative to a horizontal. The upper section 30 comprises a first portion 32 and a second portion 34. The first portion 32 of the upper section 30 is substantially parallel to the intermediate section 28 and is illustrated in a vertical orientation. The second portion 34 of the upper section 30 has a first end 33 and second end 35. The first end 33 is proximate to the intermediate section 28 and the second end 35 is distal to the intermediate section 28. In this example of the invention, the second end 35 is illustrated below proximal end 33 relative to horizontal.

Figure 3:
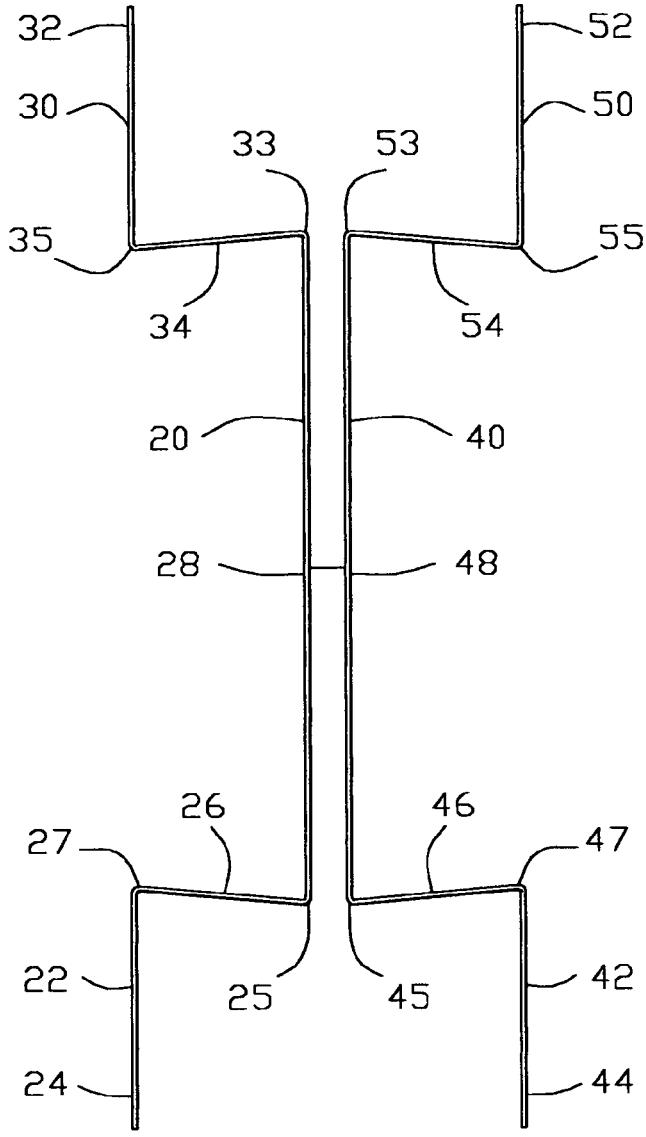
FIG. 3 is a side view of the first member and a second member of the wire support in a parallel relationship.

FIG. 3 is a side view of the first wire 20 and the second wire 40 in a parallel configuration. It should be noted that first wire 20 and second wire 40 are identical to one another. Similar parts of second wire 40 are equivalent to the parts previously identified and associated with first wire 20 in FIG. 1 increased by 20. It should be understood by those skilled in the art that forming first wire 20 and second wire 40 may be formed by any well-known wire bending or forming process. The material comprising the first wire 20 and the second wire 40 includes steel as well as any malleable material. A wire having a range in diameter of 0.125 inches to 0.5 inches are normally employed in the manufacture of the wire support 10, however it should be understood than wire diameters less than or greater than those specified above remain within the scope of this invention. The plurality of wires 20 and 40 may also include four wires with a first pair substantially at right angles to a second pair to produce a sign visible for 360 degree visibility.

Figure 4:
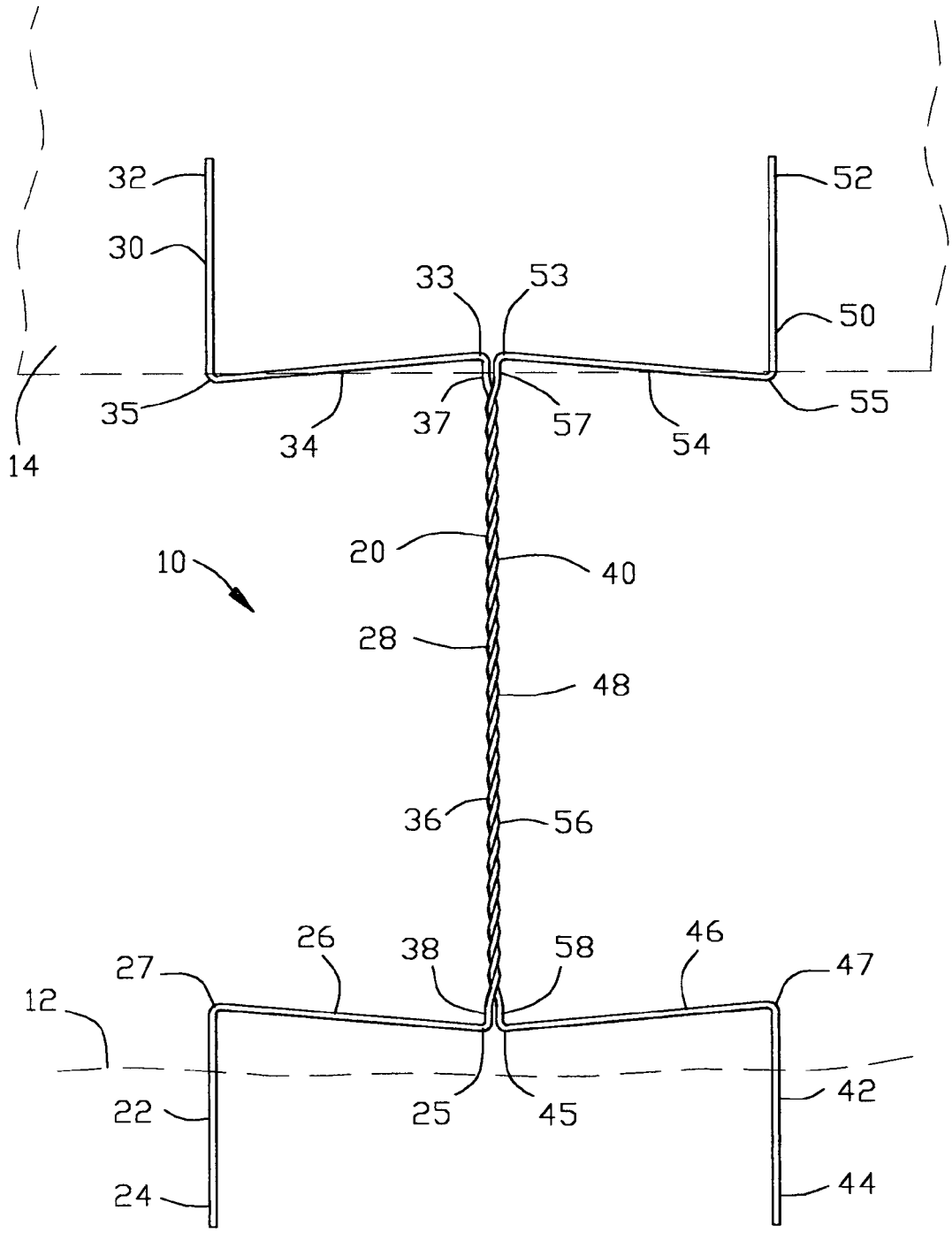
FIG. 4 is a side view of a first embodiment of the fabricated wire support of the present invention.

FIG. 4 is an enlarged side view of the wire support 10 inserted into the base surface 12 for supporting the object 14. The intermediate section 28 of first wire 20 and the intermediate section 48 of the second wire 40 are illustrated twisted forming plural helixes 36 and 56. The plural helixes 36 and 56 are spirally intertwined and impart structural rigidity to the intermediate sections 28 and 48 of the first and second wires 20 and 40 for providing upright support for the object 14. The first and second wires 20 and 40 are normally twisted and spirally intertwined in a range of two to ten turns per foot. However, it should be understood that turn ratios less than or greater than those specified above remain within the scope of this invention.

The second portions 26 and 46 of the lower sections 22 and 42 extend outwardly from the spirally intertwined intermediate sections 28 and 48 of the wires 20 and 40. The first and second portions 24 and 44 of the lower sections 22 and 42 are substantially parallel to the vertically oriented intermediate sections 28 and 48 for insertion into the base surface 12 to provide a mounting for the wire support 10. The insertion of the first and second portion 24 and 44 into the base surface 12 is facilitated by the application of a downward force by an operator on the second ends 27 and 47 of the second portion 26 and 46 of the lower section 22 and 42. The ability to apply a force directly above the vertical first portion 24 and 44 enables any operator to insert the wire support 10 into the base surface 12 having a substantially hard surface. The downward force may be exerted on the second ends 27 and 47 of second portion 26 and 46 of lower section 22 and 42 by a foot of the operator.

The second portions 34 and 54 of the upper sections 30 and 50 extend outwardly from the spirally intertwined intermediate sections 28 and 48 of the wires 20 and 40. The first and second portions 32 and 52 of the upper sections 30 and 50 are substantially parallel to the vertically oriented intermediate sections 28 and 48 for insertion into the object 14. When the object 14 is a sign comprising a corrugated material, the first and second portions 32 and 52 of the upper section 30 and 50 are inserted into the void areas of the corrugated material for providing support to the object 14. The insertion of the first and second portions 32 and 52 into the object 14 is facilitated by the application of an upward force by an operator on the second ends 35 and 55 of the second portion 32 and 52 of the upper sections 30 and 50. It should be understood that other forms of attachment of the wire support 10 to the object 14 may be utilized within the spirit of the invention. These other forms of attachment may include eye straps affixed to the object 14 capturing the first portions 32 and 52 of the upper sections 30 and 50.

In one embodiment of the invention, the intermediate sections 28 and 48 comprise short untwisted lengths of the intermediate sections 28 and 48 thereby defining upper minor lengths 37 and 57. Similarly, the intermediate section 28 and 48 comprise short untwisted lengths of the intermediate sections 28 and 48 thereby defining lower minor lengths 38 and 58. The purpose of the upper minor lengths 37 and 57 and the lower minor lengths 38 and 58 will be discussed hereinafter.

Figure 5:
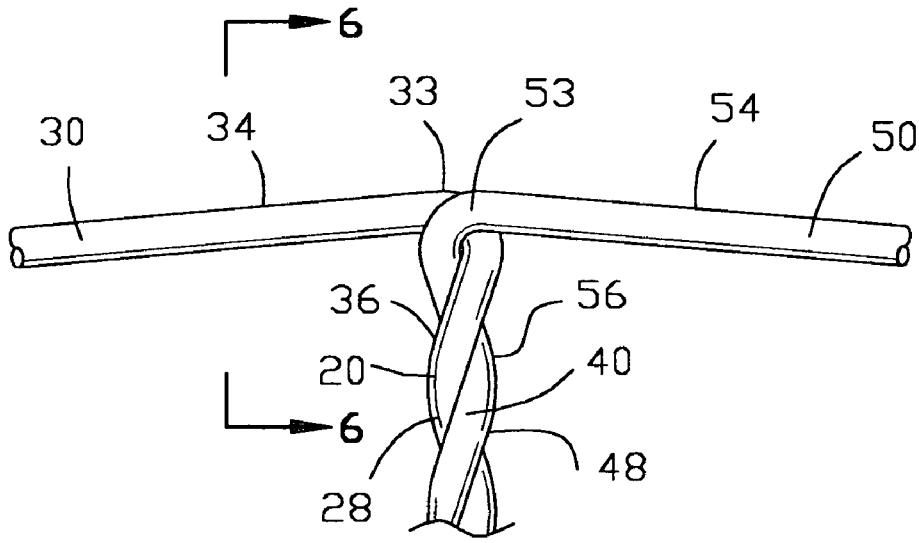
FIG. 5 is an enlarged view of a portion of FIG. 4.
Figure 6:
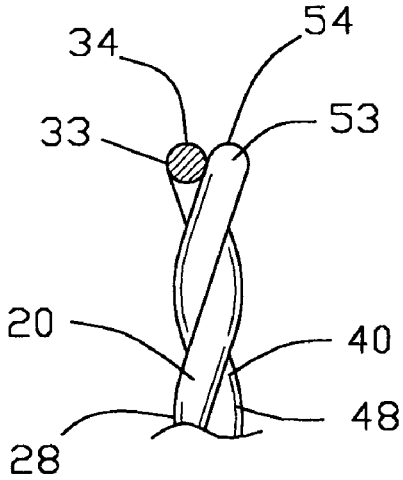
FIG. 6 is a section view along line 6-6 of FIG. 5.

FIG. 5 is a detail side view of a first embodiment of the present invention while FIG. 6 is a section view through line 6-6 of FIG. 5. This embodiment of the invention, the intermediate sections 28 and 48 of wires 20 and 40 with the intertwined twisted helixes 36 and 56 extend to the first ends 33 and 53 of the second portions 34 and 54 of the upper sections 30 and 50. The object 14 is fixed to and supported by the wire support 10 solely by the first portions 32 and 52 of the upper sections 30 and 50 of the wires 20 and 40 as shown in FIG. 4.

Figure 7:
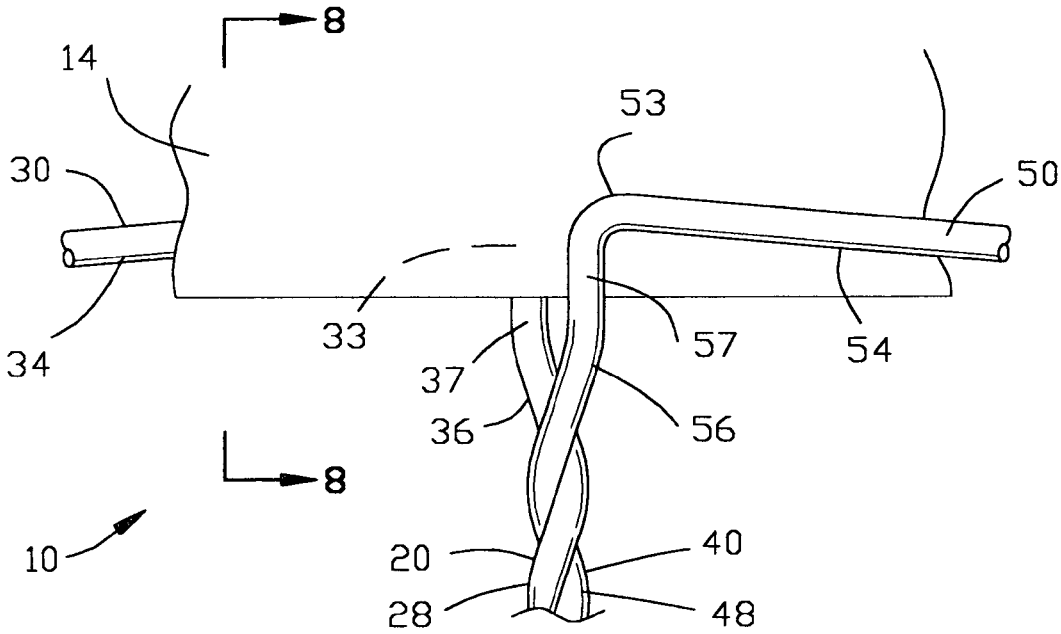
FIG. 7 is an enlarged view similar to FIG. 4 of a second embodiment of the fabricated wire support of the present invention.
Figure 8:
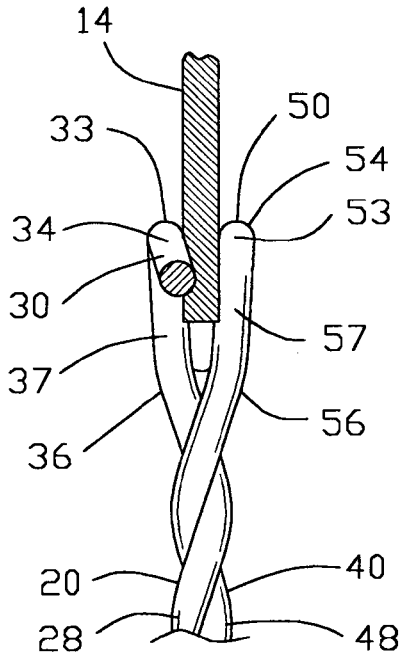
FIG. 8 is a section view along line 8-8 of FIG. 7.

FIG. 7 is a detail side view of a second embodiment of the present invention while FIG. 8 is a section view through line 8-8 of FIG. 7. In this preferred embodiment of the invention, the intermediate sections 28 and 48 of the wires 20 and 40 with the intertwined twisted helixes 36 and 56 terminate at the upper minor lengths 37 and 57. The upper minor lengths 37 and 57 extend to the first ends 33 and 53 of the second portions 34 and 54 of the upper sections 30 and 50. The distal ends 35 and 55 of the second portions 34 and 54 of the upper sections 30 and 50 are generally lower than the proximal first ends 33 and 53 relative to a horizontal.

The downward angle of the second portions 34 and 54 of the upper sections 30 and 50 enable the object 14 to be inserted between the first and second minor lengths 37 and 57 of the intermediate sections 28 and 48 coincident with the insertion of first portions 32 and 52 of the upper sections 30 and 50 into the voids in the corrugation of object 14 or alternate attachment of first portions 32 and 52 of upper sections 30 and 50 to object 14. This attachment configuration utilizing the second portions 34 and 54 of the upper section 30 and 50 provide increased rigidity and support to the object 14.

Figure 9:
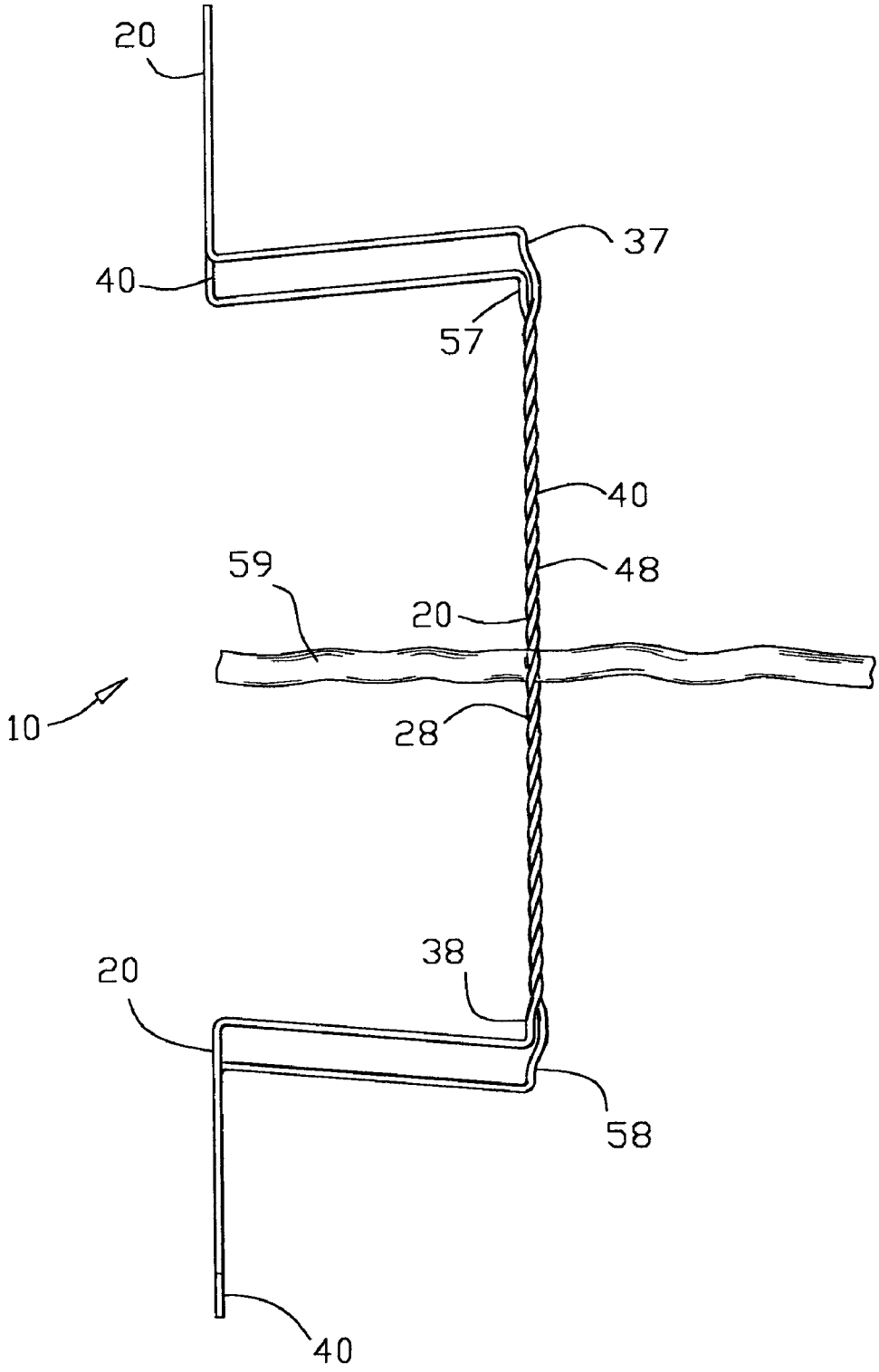
FIG. 9 is a side view of the wire support of the present invention in a folded position.

FIG. 9 is a side view of the folded first wire 20 and the second wire 40 of the present invention 10. The upper minor lengths 37 and 57 and the lower minor lengths 38 and 58 permit an axial displacement of the first intermediate section 28 relative to the second intermediate section 48 simultaneously with a rotational displacement of the first wire 20 relative to the second wire 40. These axial rotational displacements enable the wire support 10 to occupy a volume essentially equal to a single formed wire 20. This volume reduction enables larger quantities all the wire supports can to be shipped economically. Additionally, the folded wire support 10 enables an operator to more readily store and transport the wire supports 10. Optionally, a decorative and attention attracting flexible material ribbon 59 may be inserted transverse to the intermediate section 28. The flexible material ribbon 59 may comprise plastic, fabric or other material. The ribbon 59 is inserted between the first 20 and the second 40 wires prior to twisting the wires 20, 40. Following the twisting of the first 20 and the second 40 wires, the ribbon 59 is intertwined between and held captive by the first 20 and the second 40 twisted wires. It should be understood that a plurality of ribbons 59 may be inserted between the first 20 and the second 40 wires and may be a single or multicolor within the scope of the invention.

Figure 10:
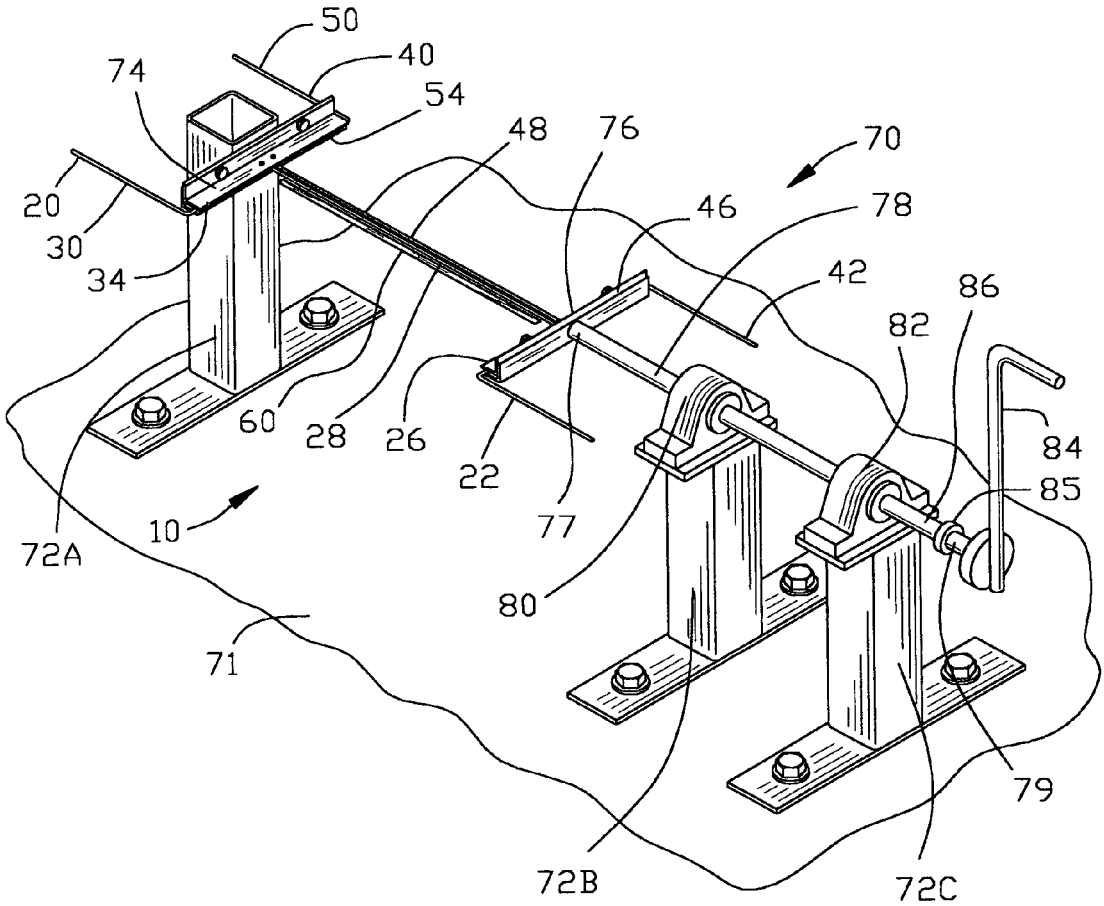
FIG. 10 is an isometric view of the first and second members of the wire support installed on a twisting apparatus.

FIG. 10 is an isometric view of the first and second wires 20 and 40 of the present invention 10 installed on a twisting apparatus 70. The twisting apparatus 70 is affixed to base surface 71. A first clamp 74 is affixed to a stand 72A and a second clamp 76 is affixed to a first end 77 of a shaft 78. The shaft 78 extends through and is supported by a plurality of pillow blocks 80 and 82 mounted on stands 72B and 72C respectively. The pillow blocks 80 and 82 comprise bushings or bearings and impart lateral rigidity to the shaft 78 while allowing both rotational and axial movement of the shaft 78. A hand crank 84 is affixed to a second end 79 of the shaft 78. It should be understood that replacement of the crank 84 with any other device capable of producing rotary motion of the shaft 78 is within the scope of this invention.

The first and second wires 20 and 40 are formed as previously discussed using any of the well known wire forming techniques. The intermediate sections 28 and 48 of the wires 20 and 40 are located adjacent and parallel to one another with the second portions 34 and 54 of the upper sections 30 and 50 of the wires 20 and 40 being removably affixed by the first clamp 74. The second portions 26 and 46 of the wires 20 and 40 are affixed by the second clamp 76. The shaft 78 is illustrated in a first axial position 86. A stop 85 is adjustably affixed to and limits the axial movement of the shaft 78 as will be discussed. Optionally, a decorative and attention attracting flexible material ribbon 60 may helically twisted with the first 20 and second 40 wires in the intermediate section 28. The flexible material ribbon 60 may comprise plastic, fabric or other material and may be a single or plural ribbons 60 of a single or multicolor. The ribbon 59 is inserted between the first 20 and the second 40 wires prior to twisting the wires 20, 40. Following the twisting of the first 20 and the second 40 wires, the ribbon 59 is intertwined between and held captive by the first 20 and the second 40 twisted wires. It should be understood that a plurality of ribbons 59 may be inserted between the first 20 and the second 40 wires within the scope of the invention.

Figure 11:
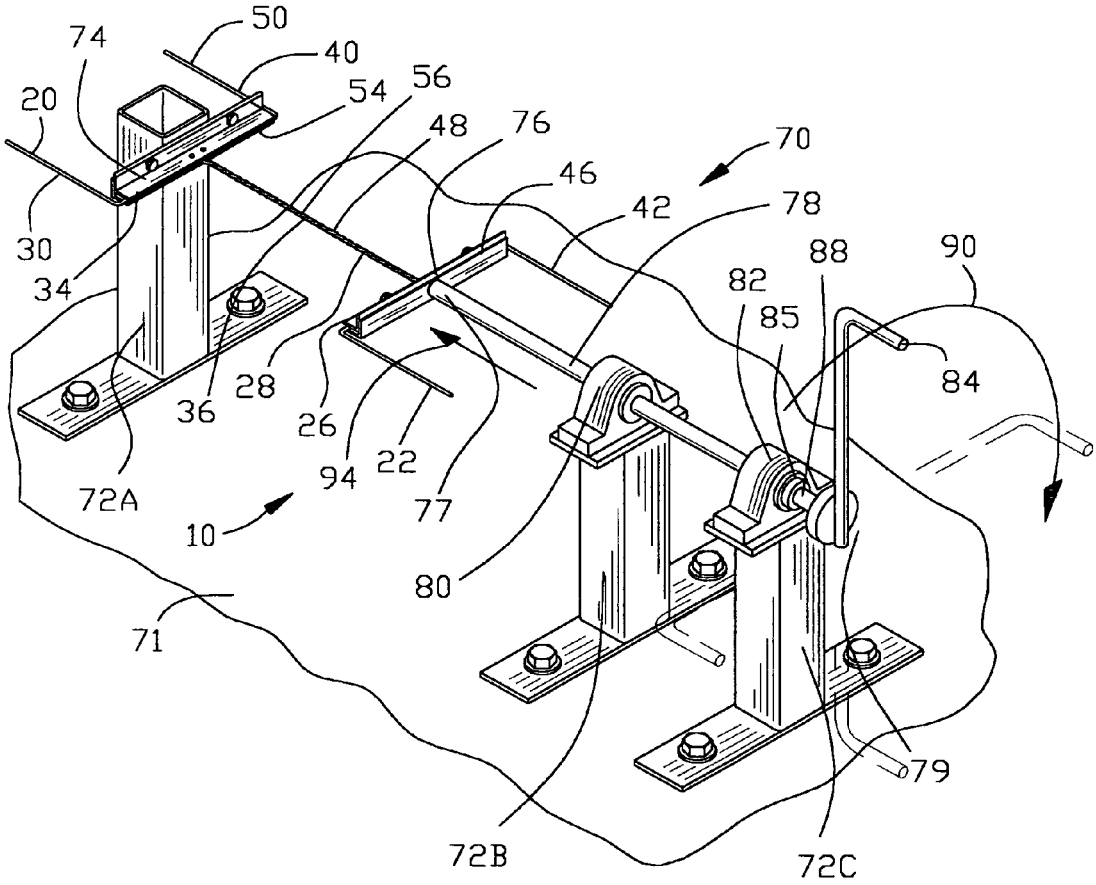
FIG. 11 is a view similar to FIG. 10 illustrating the first and second members of the wire support being twisted in a first twisting action.

FIG. 11 is an isometric view of the apparatus of FIG. 10 illustrating a first twisting action. Rotation of the crank 84 in a first direction 90 results in the intermediate sections 28 and 48 of the wires 20 and 40 forming a plurality of winds of a twisted intertwined helixes 36 and 56. Compensation for the reduction in length of the intermediate sections 28 and 48 due to twisting action imparted by the rotation of the shaft 78 in a first direction 90 is accomplished by the axial displacement of the shaft 78 in a direction indicated by axial displacement arrow 94. This axial displacement results in a relocation of shaft 78 to a second shaft position 88. The stop 85 is adjusted to limit the axial movement of the shaft 78, which effectively controls the number of turns which may be applied to the first and second intermediate sections 28 and 48. This first twisting action results in a plurality of winds of intertwined helixes 36 and 56 terminating at the first ends 25 and 45 and the second end 33 and 53 as previously discussed in FIGS. 5 and 6.

Figure 12:
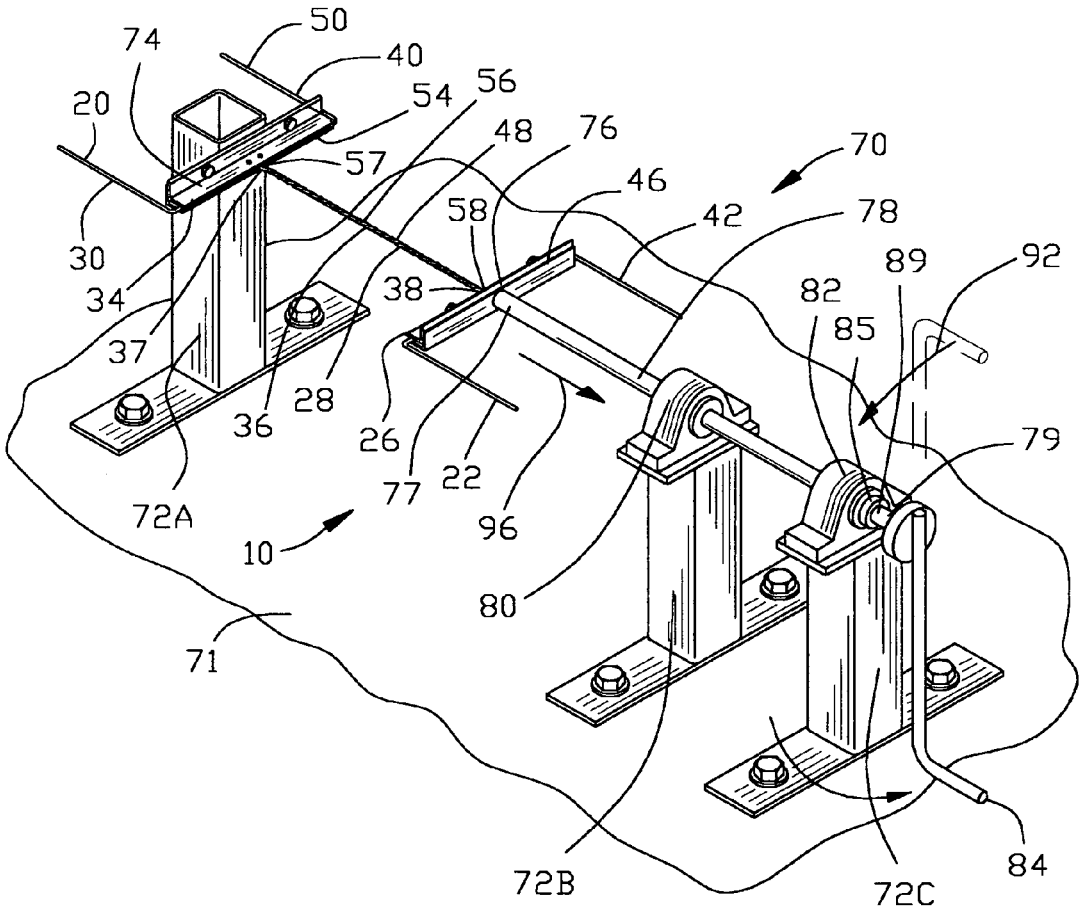
FIG. 12 is a view similar to FIG. 11 illustrating the first and second members of the wire support being twisted in a second twisting action.

FIG. 12 is an isometric view of the apparatus of FIG. 10 illustrating a second twisting action. The rotation of the crank 84 in a second direction 92 results in a minor untwisting of the twisted intertwined helixes 36 and 56. Compensation for the slight increase in length of the intermediate sections 28 and 48 due to untwisting action imparted by the rotation of the shaft 78 in a second direction 92 is accomplished by the axial displacement of the shaft 78 in a direction indicated by axial displacement arrow 96 resulting in a relocation of the shaft 78 to a third shaft position 89. This second twisting action results in a plurality of intertwined helixes 36 and 56 terminating with the first and second upper minor lengths 37 and 57 and the first and second lower minor lengths 38 and 58 as previously discussed in FIGS. 7 and 8. Following the second twisting action, the first and second clamps 74 and 76 are removed from the wire support 10.

Figure 13:
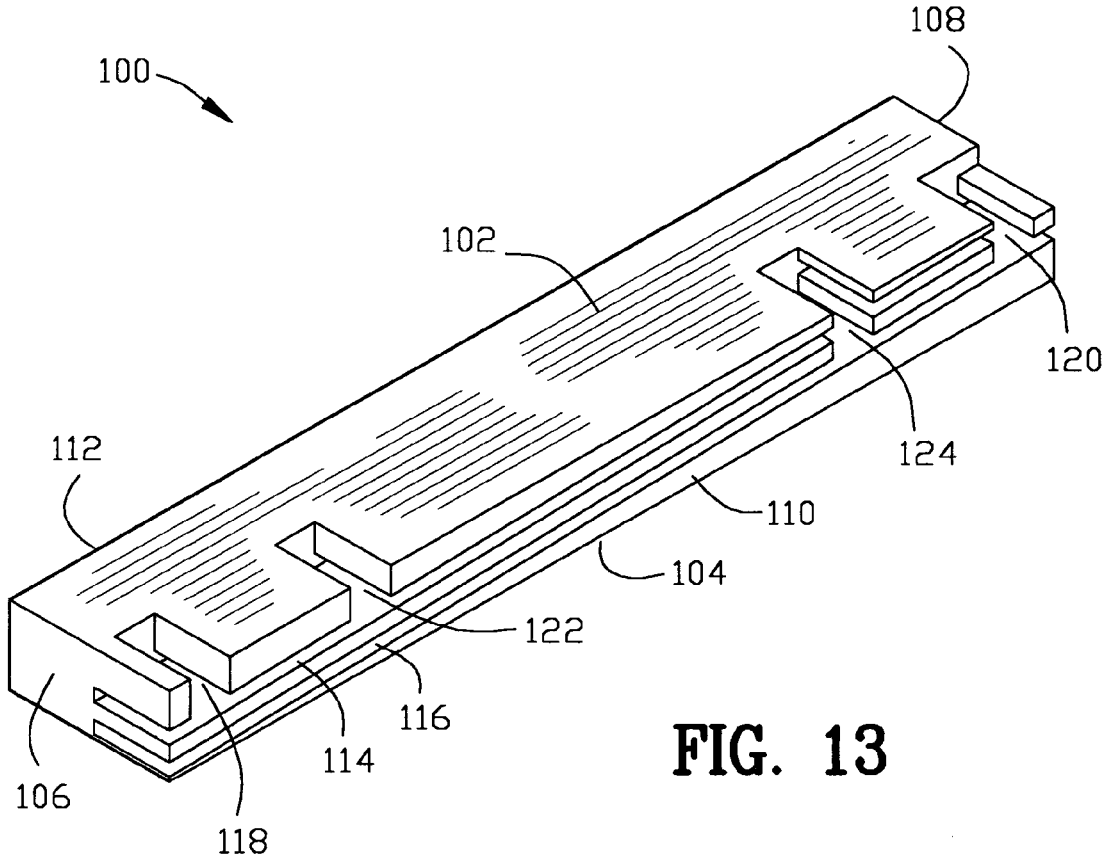
FIG. 13 is an isometric view of a preferred embodiment of a form for securing the first and second wires on the twisting apparatus.
Figure 14:
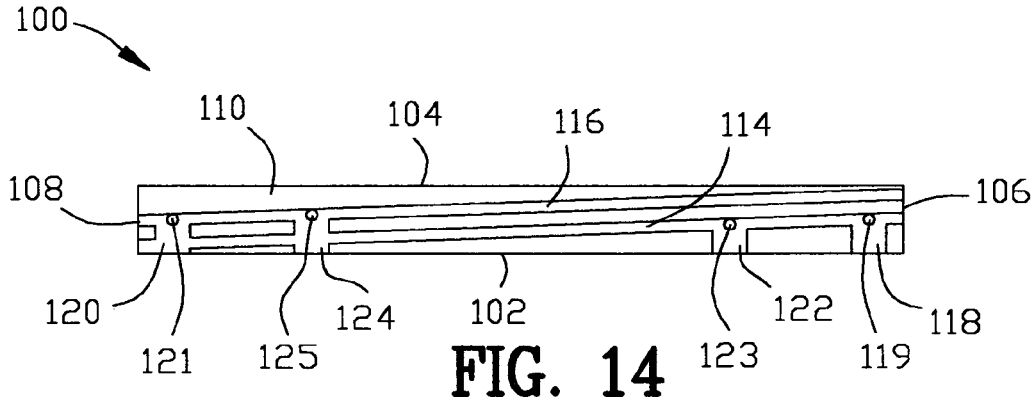
FIG. 14 is a front view of the form of FIG. 13.
Figure 15:
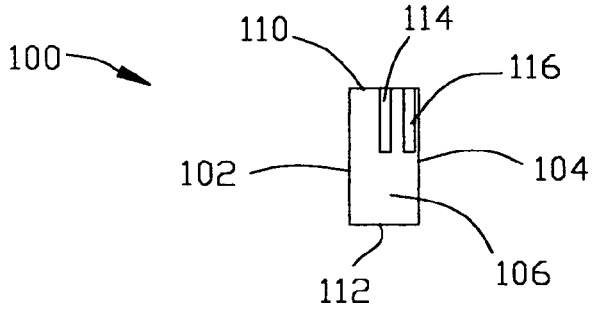
FIG. 15 is an end view of the form of FIG. 13.
Figure 16:
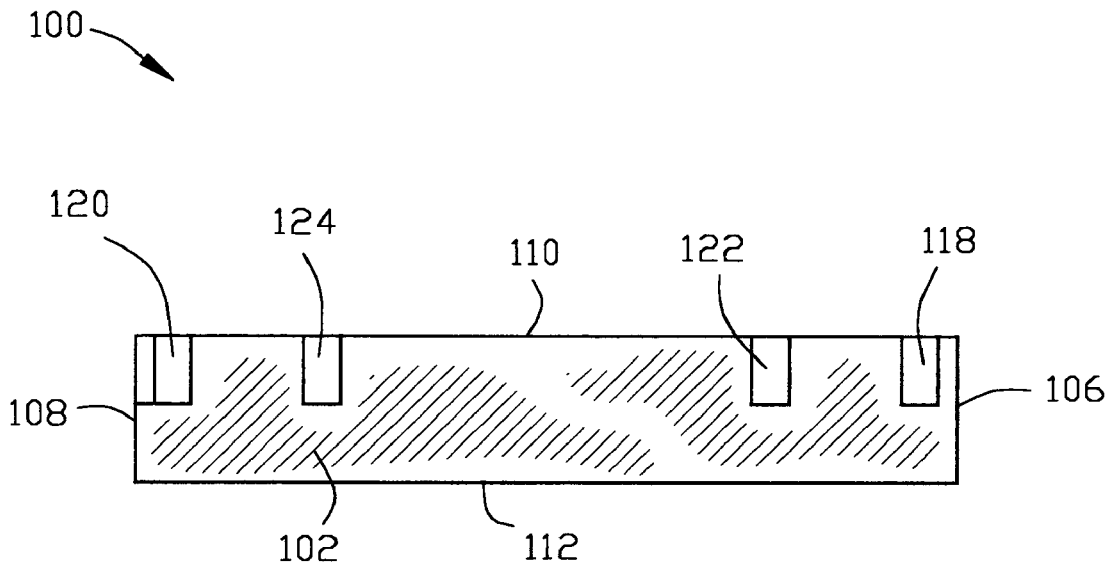
FIG. 16 is a top view of the form of FIG. 13.
Figure 17:
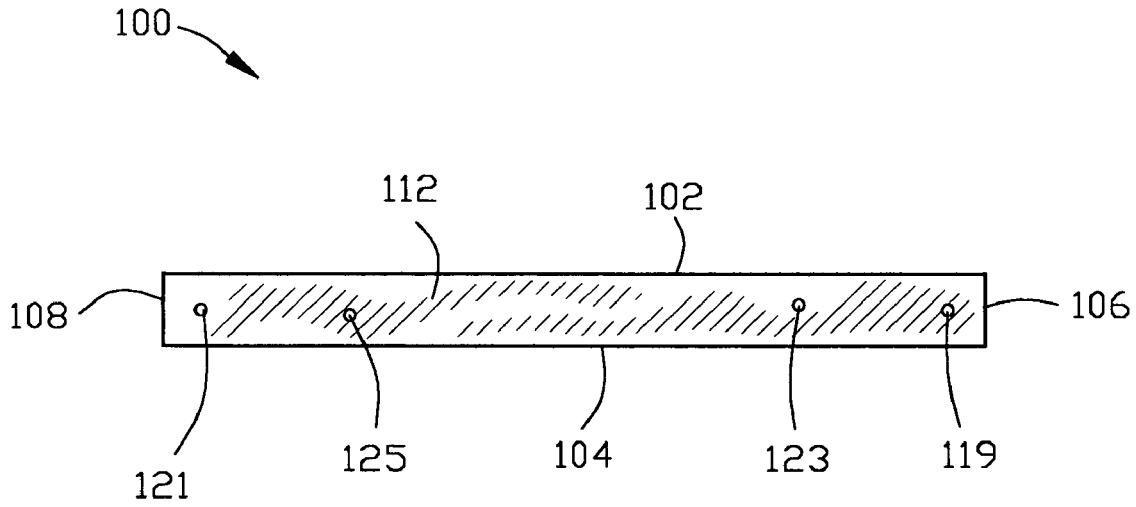
FIG. 17 is a rear view of the form of FIG. 13.

FIG. 13 through FIG. 17 illustrate a preferred embodiment of a form 100 for securing the first 20 and the second 40 wires on the twisting apparatus 70. FIG. 13 is an isometric view of the form 100 which may be constructed from steel or other materials suitable for the purpose. FIG. 14 is a front view, FIG. 15 is an end view, FIG. 16 is a top view, and FIG. 17 is a rear view of the form 100 of FIG. 13. The form 100 comprises a top 102 and a bottom 104 surface, a first 106 and a second 108 end surface, and a front 110 and rear surface 112. A first 114 and a second 116 slot on the front surface 110 extends from the first 106 to the second 108 end surfaces. A plurality of notches 118, 120, 122, and 124 extend from the front surface 110 to proximate mid point of the top surface 102. Notches 118 and 122 extend downward from the top surface 102 to the first slot 114. Notches 120 and 124 extend downward from the top surface 102 to second slot 116. A plurality of holes 119, 121,123, and 125 extend from the rear surface 112 to notches 118, 120, 122, and 124 respectively. The first 114 and second 116 slots are angularly displaced along front edge 110 of form 100. Since holes 119 and 121 are centered relative to the height of block 100, the angular displacement is required to achieve the desired upper minor lengths 37, 57 and lower minor lengths 38, 58 configuration.

Figure 18:
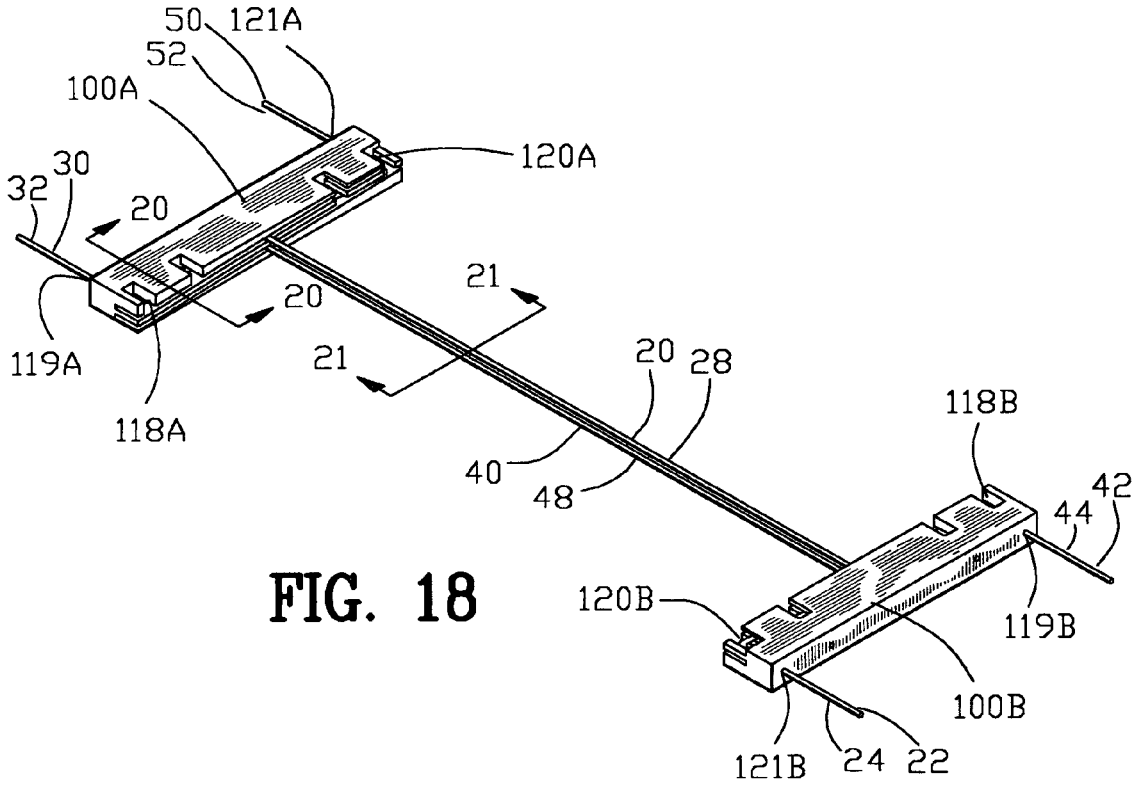
FIG. 18 is an isometric view of a first and a second form of FIG. 13 illustrated with a first and second wire before twisting.
Figure 19:
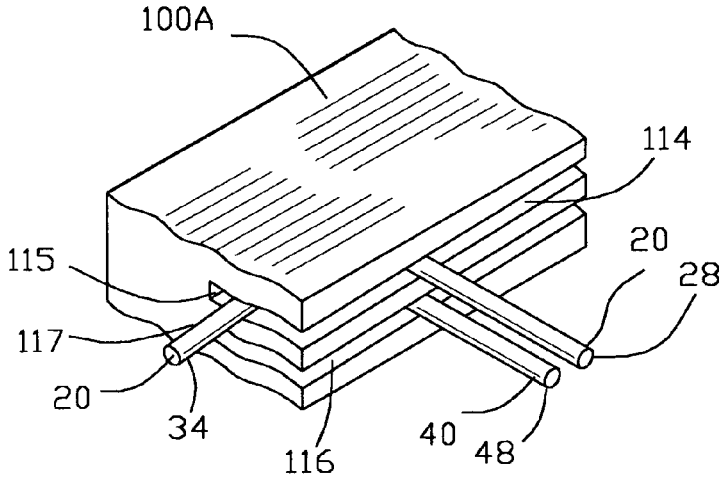
FIG. 19 is a cut away view of a central section of the form of FIG. 13 illustrating a first and second wire before twisting.
Figure 20:
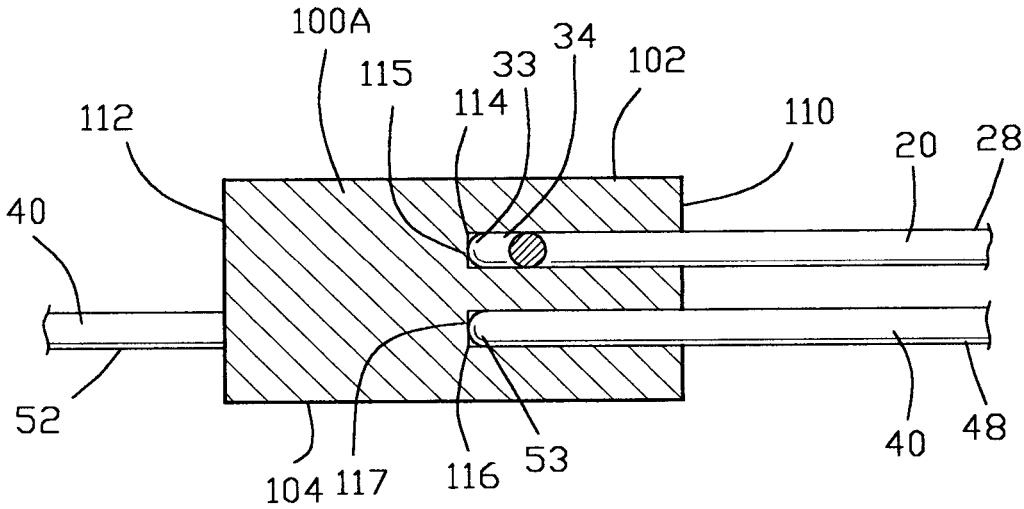
FIG. 20 is a cross-sectional view along line 20-20 in FIG. 18.
Figure 21:
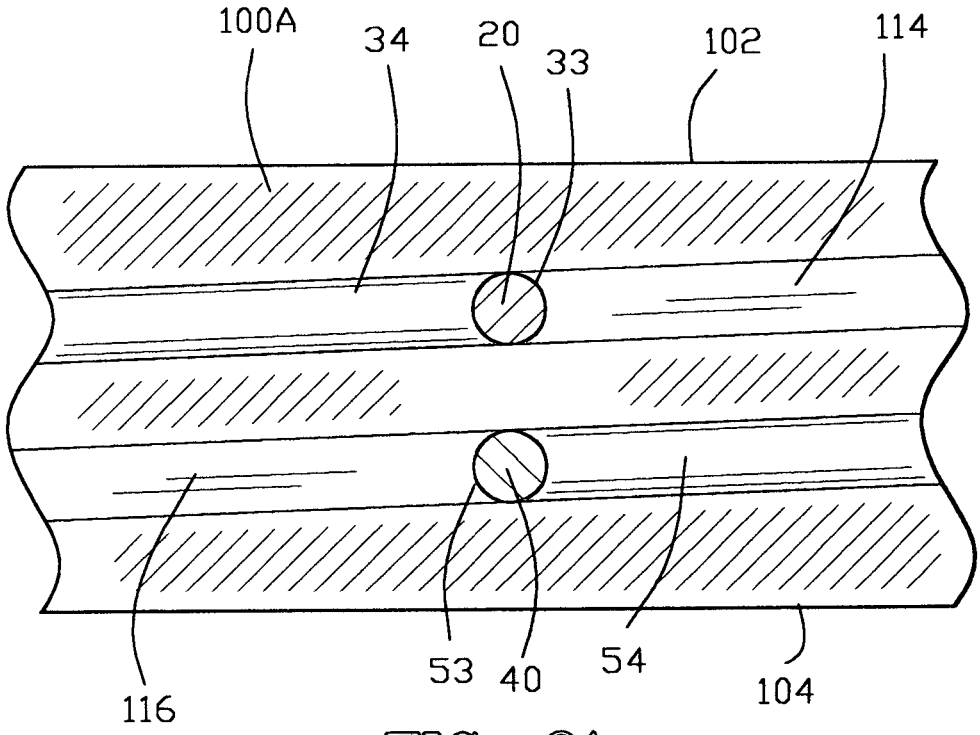
FIG. 21 is a cross-sectional view along line 21-21 in FIG. 18.

FIGS. 18, 19, 20, and 21 illustrate form 100 prior to twisting the first 20 and the second 40 wires. FIG. 18 is an isometric view of a first 100A and a second 100B form with a first 20 and a second 40 wire before twisting. FIG. 19 is a cut away view of a central section, FIG. 20 is a cross-sectional view along line 20-20 in FIG. 18, FIG. 21 is a cross-sectional view along line 21-21 in FIG. 18. Form 100A is affixed to a fixed stand and base 72A of twisting apparatus 70 as illustrated in FIGS. 10 and 11. Form 100B is affixed to a rotatable clamp 76 as illustrated in FIGS. 10 and 11.

FIG. 18 illustrates the installation of a first 20 and a second 40 wire on twisting apparatus 70. A first wire 20 is inserted into slot 114A of form 100A with first portion 32 of upper section 30 of wire 20 inserted through hole 119A. Notch 118A facilitates the location of hole 119A during the insertion process. The first wire 20 is inserted into slot 116B of form 100B with first portion 24 of lower section 22 of wire 20 inserted through hole 121B. Notch 120B facilitates the location of hole 121B during the insertion process.

A second wire 40 is inserted into slot 116A of form 100A with first portion 52 of upper section 50 of wire 40 inserted through hole 121A. Notch 120A facilitates the location of hole 121A during the insertion process. The second wire 40 is inserted into slot 114B of form 100B with first portion 44 of lower section 42 of wire 40 inserted through hole 119B. Notch 118B facilitates the location of hole 119B during the insertion process.

Holes 123 and 125 correspond to holes 119 and 121 respectively, and are utilized in the formation of a wire support 10 of a size smaller than that formed when using holes 119 and 121.

As best illustrated in FIGS. 20 and 21 when properly positioned in form 100A the first ends 33 and 53 of second end portions of first 20 and second 40 wires respectively are in direct contact with the first and second slot base 115 and 117 of form 100A, while the second portions 34 and 54 of first 20 and second 40 wires respectively are displaced from direct contact with the first and second slot base 115 and 117 of form 100A. As previously discussed and illustrated in FIG. 4, the downward angle of the second portions 34 and 54 of the upper sections 30 and 50 enable the object 14 to be inserted between the first and second minor lengths 37 and 57 of the intermediate sections 28 and 48 coincident with the insertion of first portions 32 and 52 of the upper sections 30 and 50 into the voids in the corrugation of object 14 or alternate attachment of first portions 32 and 52 of upper sections 30 and 50 to object 14. This attachment configuration utilizing the second portions 34 and 54 of the upper section 30 and 50 provides increased rigidity and support to the object 14.

Figure 22:
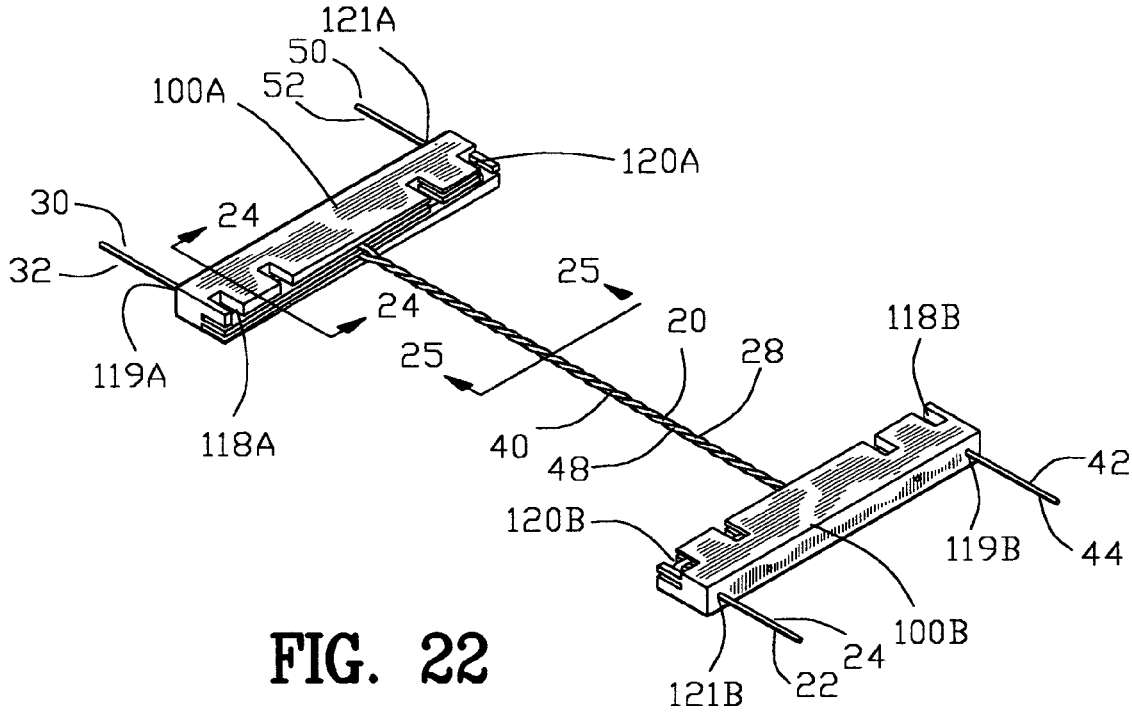
FIG. 22 is an isometric view of a first and a second form of FIG. 13 illustrated with a first and second wire after twisting.
Figure 23:
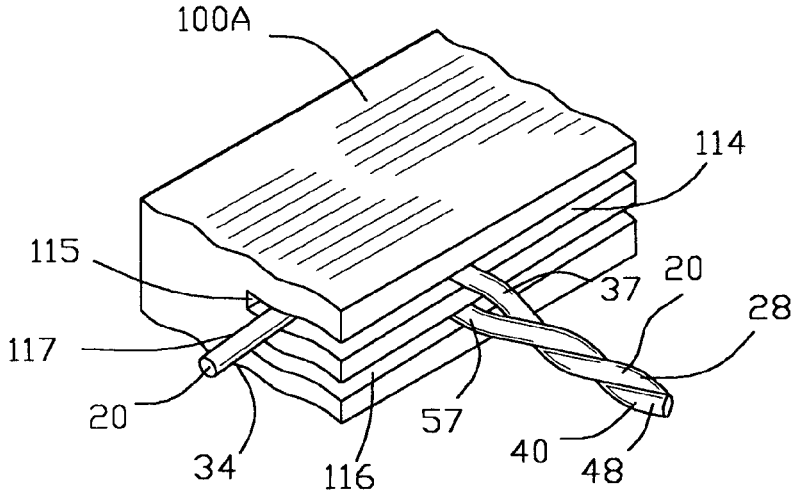
FIG. 23 is a cut away view of a central section of the form of FIG. 13 illustrating a first and second wire after twisting.
Figure 24:
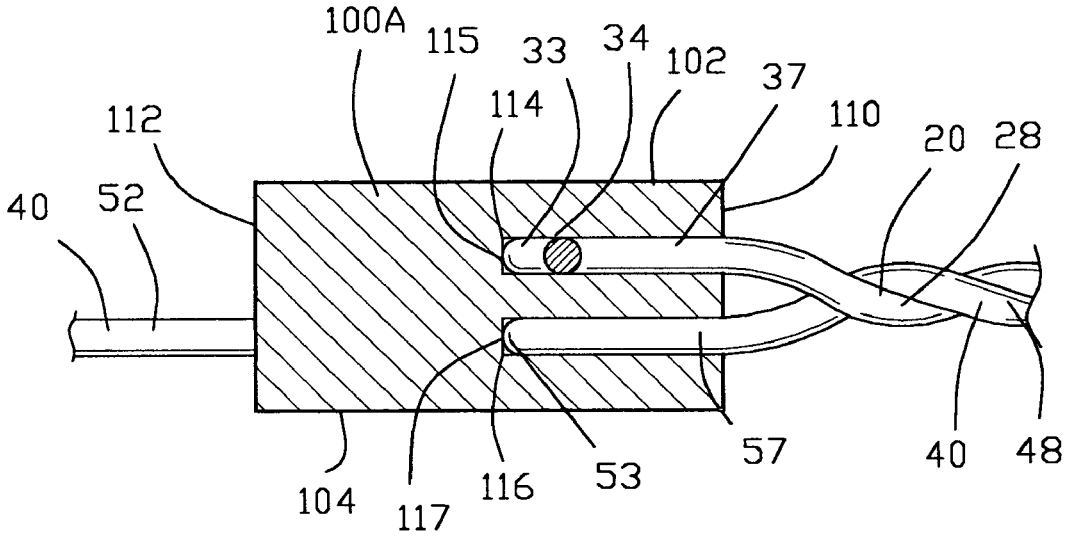
FIG. 24 is a cross-sectional view along line 24-24 in FIG. 22.
Figure 25:
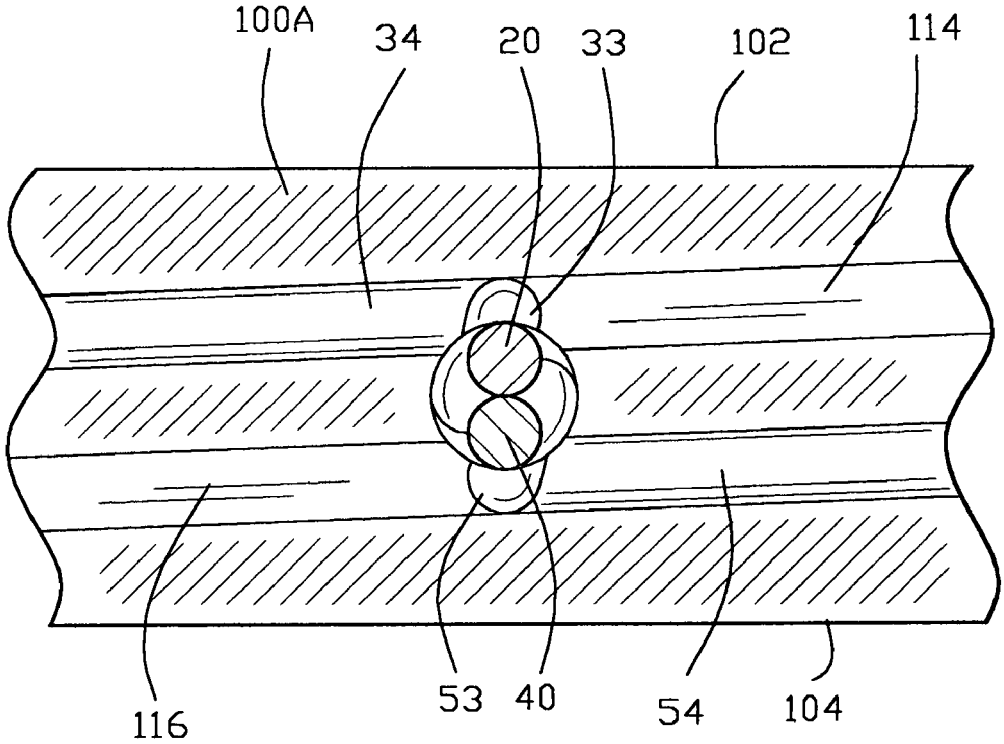
FIG. 25 is a cross-sectional view along line 25-25 in FIG. 22.

FIGS. 22, 23, 24 and 25 illustrate form 100 following the twisting of the first 20 and the second 40 wires. FIG. 22 is an isometric view, FIG. 23 is a cut away view, FIG. 24 is a cross-sectional view along line 24-24 in FIG. 22; and FIG. 25 is a cross-sectional view along line 25-25 in FIG. 22. Rotation of form 100B relative to form 100A effects the twisting and formation of an intertwined helix of first 20 and second 40 wires. Typically, the intermediate sections 28 and 48 of the first 20 and second 40 wires respectively are twisted between two and ten turns per foot. However, it should be understood that turn ratios less than or greater than those specified above remain within the scope of this invention.

As best shown in FIGS. 23, 24 and 25, upper minor lengths 37 and 57 and lower minor lengths 38 and 58 of intermediate sections 28 and 48 of first and second wires 20 and 40 are formed during the twisting action of form 100B relative to form 100A. The first 114 and second 116 slots prevent twisting of first 20 and second 40 wires resulting in formation of the upper minor lengths 37 and 57 and the lower minor lengths 38 and 58. Utilization of form 100 in the twisting process establishes the upper 37 and 57 and lower 38 and 58 minor lengths in the intermediate sections 28 and 48 of wires

20 and 40 concurrent with the twisting of wires 20 and 40. Thus eliminating a second step of rotation reversal to create the upper 37 and 57 and lower 38 and 58 minor lengths.

The present disclosure includes that contained in the appended claims as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

What is claimed is:

1. A wire support for supporting a sheet material from a base surface, the sheet material having a plurality of void areas, comprising:

a first wire comprising a one piece member having a first lower section, a first intermediate section and a first upper section;

a second wire comprising a one piece member and having a second lower section, a second intermediate section and a second upper section;

each of said first and second wires being identical to one another;

said first and second wires being spirally twisted along said first and second intermediate sections forming a first and a second intertwined helix to provide an upright support;

said first and second lower sections of said first and second wires extending outwardly in opposite directions from said upright support and terminating in first and second lower distal area extending generally parallel to said upright support for enabling said first and second lower distal area of said first and second lower sections to be inserted into the base surface to mount the wire support;

said first and second upper sections of said first and second wires having an first and second upper regions extending outwardly in opposite directions from said upright support and terminating in first and second upper distal area extending generally parallel to said upright support for insertion into two of the plurality of void areas of the sheet material to support the sheet material relative to the base surface;

an upper end of said upright support defining a minor length whereat said first and said second wires are untwisted to provide a first and a second spaced apart straight portion of said first and said second wires, respectively; and said first and second upper regions extending outwardly at an angle toward said first and second lower sections of said first and second wires, respectively, for enabling the sheet material to be inserted between said first and second spaced apart straight portions to lateral support the sheet material therein.

2. A wire support for supporting a sheet material as set forth in claim 1, including a flexible material ribbon being spirally twisted within said first and second intertwined helixes of said upright support to extend outwardly and transverse to said upright support.

3. A wire support for supporting a sheet material from a base surface, the sheet material having a plurality of void areas, comprising:

a first wire comprising a one piece member having a first lower section, a first intermediate section and a first upper section;

a second wire comprising a one piece member and having a second lower section, a second intermediate section and a second upper section;

each of said first and second wires being identical to one another;

said first and second wires being spirally twisted along said first and second intermediate sections forming a first and a second intertwined helix to provide an upright support;

said first and second lower sections of said first and second wires extending outwardly in opposite directions from said upright support and terminating in first and second lower distal area extending generally parallel to said upright support for enabling said first and second lower distal area of said first and second lower sections to be inserted into the base surface to mount the wire support;

said first and second upper sections of said first and second wires having an first and second upper regions extending outwardly in opposite directions from said upright support and terminating in first and second upper distal area extending generally parallel to said upright support for insertion into two of the plurality of void areas of the sheet material to support the sheet material relative to the base surface;

an upper end of said upright support defining a minor length whereat said first and said second wires are untwisted to provide a first and a second spaced apart straight portion of said first and said second wires, respectively;

said first and second upper regions extending outwardly at an angle toward said first and second lower sections of said first and second wires, respectively, for enabling the sheet material to be inserted between said first and second spaced apart straight portions to lateral support the sheet material therein; and said first and second upper and lower spaced apart straight portions enabling said first wire to be rotated about said first and second intertwined helix of said upright support relative to said second wire to move said first lower and upper sections adjacent to said second lower and upper section to fold the wire support.

* * * * *